United States Patent [19]

Satoh

[11] Patent Number: 4,939,971

[45] Date of Patent: Jul. 10, 1990

[54] TREMOLO DEVICE FOR A GUITAR

[76] Inventor: Hiroaki Satoh, Townhouse Soshigaya 203, 6-14-1, Kamisoshigaya, Setagaya-ku, Tokyo, Japan

[21] Appl. No.: 251,896

[22] Filed: Sep. 30, 1988

[30] Foreign Application Priority Data

Oct. 6, 1987 [JP] Japan ..... 62-25057

[51] Int. Cl.[5] ..... G10D 3/12

[52] U.S. Cl. ..... 84/313

[58] Field of Search ..... 84/313

[56] References Cited

U.S. PATENT DOCUMENTS

| | | | |
|---|---|---|---|
| 2,741,146 | 4/1956 | Fender | 84/313 |
| 3,248,991 | 5/1966 | Cole | 84/313 |
| 4,555,970 | 12/1985 | Rose | 84/313 |
| 4,674,389 | 6/1987 | Fender | 84/313 |
| 4,843,941 | 7/1989 | Nichols et al. | 84/313 |

*Primary Examiner*—Lawrence R. Franklin

*Attorney, Agent, or Firm*—McAulay Fisher Nissen & Goldberg

[57] ABSTRACT

A tremolo device for a guitar includes an upper plate pivotably mounted about a first fulcrum on a guitar body, at least one spring urging the upper plate in one rotating direction, a part of the guitar body coming into contact with the upper plate to limit the rotation thereof in the one rotating direction, to bring the upper plate to a predetermined position, and a lower plate pivotably mounted about a second fulcrum and pulled in another direction opposite to the one direction by the tension of strings of the guitar. The rotation of the lower plate is limited by the upper plate in the predetermined position when the tremolo device is inactivated, and when the tremolo device is activated in such a manner that the lower plate is rotated in the other direction, the upper and lower plates are rotated together, but when the tremolo device is activated in such a manner that the lower plate is rotated inthe one direction, only the lower plate is rotated.

18 Claims, 3 Drawing Sheets

TREMOLO DEVICE FOR A GUITAR

BACKGROUND OF THE INVENTION

1. Field of the Invention

The present invention relates to a tremolo device for a guitar, and more particularly, it relates to a device enabling a precise return to an original and normal tuning of strings of the guitar after the tremolo device has been used.

2. Description of the Related Art

In general, a guitar, for example, an electric guitar, equipped with a tremolo device which is moved linearly along the strings of the guitar to produce desired variations in musical tones obtained by, for example, plucking the strings, is well-known and widely used. Known conventional tremolo devices include a synchronized type of device fitted to guitars made by the Fender Company (U.S. Pat. No. 2,741,146), a "Bigsby" type of device fitted to guitars made by the Gibson Company, and a "Moseley" type of device fitted to guitars made by the Mosrite Company, and these tremolo devices have basically similar constructions.

Namely, in the construction of these devices springs are provided having a tension almost the same as the total tension of the strings of the guitar, and while an equilibrium is maintained between the tension of the springs and the total tension of the strings, the tones of the strings of the guitar are raised or lowered by moving a load member, i.e., a tremolo arm, upward or downward, and thus rotating the whole tremolo device about one fulcrum on a guitar body to thereby vary the tension of the guitar strings.

In the conventional tremolo devices mentioned above, however, the following problems arise because the whole of the device is always in a "floating" condition around one fulcrum, while maintaining an equilibrium between the tension of the springs and the tension of the strings.

In an ideal tremolo device, after the force applied to a tremolo arm is released, the tones raised or lowered by the device are returned precisely to the original and normal tuning in which the equilibrium between the tension of springs and the total tension of strings is maintained. In practice, however, since the whole device is in the floating condition as mentioned above, deviations in the tones may occur which cannot be compensated by the restoring force derived from the tensions of the springs or strings, and thus the guitar will be out of tune in the normal condition i.e., when the tremolo device is inactivated.

Further, when the guitarist holds the guitar body, especially near the tremolo device, to play the guitar in the normal mode, or to dampen the vibration of the strings to thereby mute the sounds of the guitar, if the guitarist should inadvertently touch the conventional tremolo device, the device may rotate about the fulcrum because of the floating construction thereof, to thereby raise the tones of the guitar despite the guitarist's intentions.

Furthermore, if one or more strings are broken during playing, the equilibrium of the remaining strings will be lost, whereby all of the tones of the strings will be lowered, thus making further use of the guitar impossible.

SUMMARY OF THE INVENTION

An object of the present invention is to solve the above mentioned problems by providing a tremolo device for a guitar, by which it is possible to precisely return to an original and normal tuning after using the tremolo device, and further, by which it is possible to maintain the original tuning without deviation even if the guitarist touches the tremolo device or one or more strings have been broken.

The above object is achieved, according to the present invention, by providing a tremolo device for a guitar comprising:

(1) first plate means pivotably mounted about a first fulcrum on a guitar body;

(2) urging means for urging said first plate means in one rotating direction;

(3) stop means coming into contact with said first plate means to limit the rotation of said first plate means in said one rotating direction, to thereby bring said first plate means to a predetermined position;

(4) second plate means pivotably mounted about a second fulcrum and pulled in another direction opposite to said one rotating direction by a tension of strings of said guitar; a rotation of said second plate means being limited by said first plate means in said predetermined position when said tremolo device is inactivated;

said first and second plate means being rotated together in said another direction when said tremolo device is activated in such a manner that said second plate means is rotated in said another direction, and only said second plate means being rotated in said one rotating direction when said tremolo device is activated in such manner that said second plate means is rotated in said one rotating direction.

DESCRIPTION OF THE PREFERRED EMBODIMENTS

Figure 1:
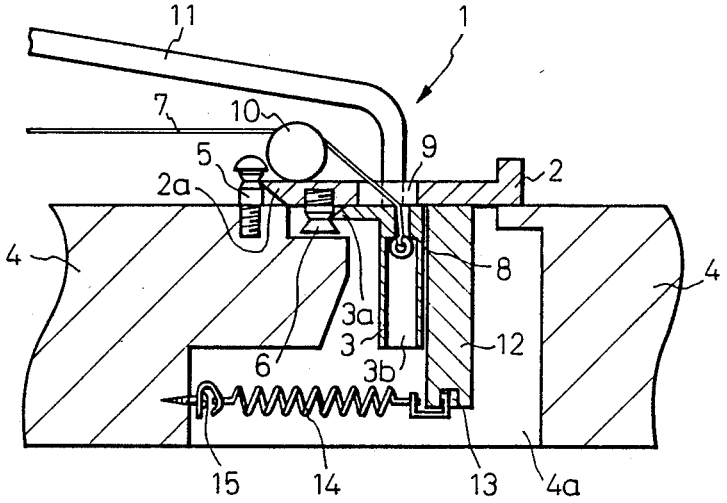
FIG. 1 is a partial longitudinal view of a guitar, showing a tremolo device in an inactivated condition according to a first embodiment of the present invention, and taken along the lines I—I of FIG. 2.
Figure 2:
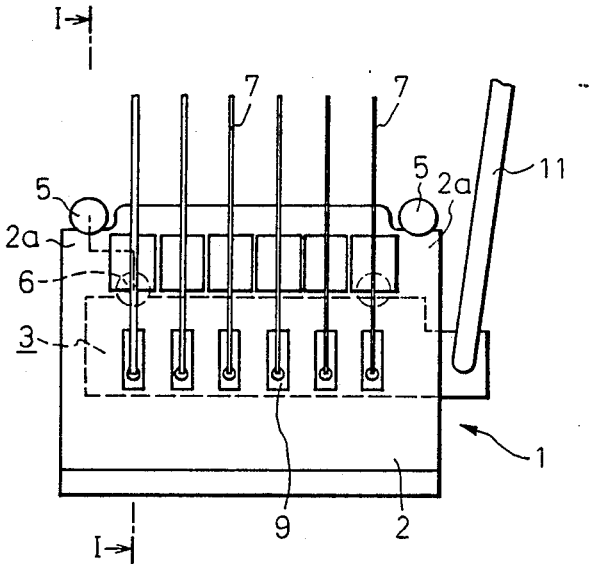
FIG. 2 is a plan view of a tremolo device according to the first embodiment of the invention.

Referring to FIGS. 1 and 2, reference numeral 1 designates a tremolo device for a guitar in accordance with the present invention. The tremolo device 1 includes an upper plate 2 and a lower plate 3. Knife-edge-shaped abutments **2*a* are located at the front end and on opposite sides of the upper plate 2, and these abutments 2*a* come into contact with screws 5 screwed into a guitar body 4, to provide a first fulcrum about which the upper plate 2 is pivotably mounted. Similarly, at the front end of the lower plate 3, knife-end-shaped abutments 3*a* are located and come into contact with screws 6 positioned on the lower surface 2*b*** of the upper plate 2. The screws 6 provide a second fulcrum about which the lower plate 3 is pivotably mounted.

Reference numerals 7 designate strings of the guitar, and the extremity of each string 7 is provided with an anchor element 8 which is seated in an elongated portion of a corresponding bore 3*b* formed in the lower plate 3. Each string 7 is then passed over a string saddle 10 and through a corresponding hole 9 formed in the upper plate 2, and the other extremity of each string 7 is fixed to a tuning peg in a not shown guitar head. Secured in the lower plate 3 is a tremolo arm 11 by which the lower plate 3 is rotated about the second fulcrum, i.e., the screw 6.

Secured to the lower surface of the upper plate 2 is a bar 12 which extends into a guitar hole 4*a*. The bar 12 is provided with recesses 13 at the lower extremity thereof, and a plurality of tension springs 14 are engaged at one end in the recesses 13. The other ends of the tension springs 14 are connected to the guitar body 4 by screws 15 screwed therein. Note, the plurality of tension springs 14 can be replaced by one tension spring. The tension springs 14 urge the upper plate 2 to rotate in the clockwise direction in FIG. 1 about the first fulcrum, i.e., the screw 5, against a rotating force in the other direction, i.e., anti-clockwise in FIG. 1. The rotating force is derived from the total tension of the strings 7 fixed in the lower plate 3.

Namely, the tension of the springs 14 is preset in such a manner that the rotating force of the upper plate 2 in the clockwise direction is larger than that of the lower plate 3 in the anticlockwise direction due to the tension of the strings 7. But, when the tremolo device 1 is inactivated as shown in FIG. 1, the clockwise movement of the upper plate 2 is limited because the rear end thereof comes into contact with a part of the guitar body 4, so that the upper plate 2 is brought to a predetermined position shown in FIG. 1 in a condition such that the upper plate 2 limits the rotation of the lower plate 3 in the anticlockwise direction by coming into contact with the lower plate 3, and in this position of the lower plate 3, a normal and original tuning of the strings 7 of the guitar will be obtained.

The operation of the above mentioned tremolo device is as follows:

When a guitarist plays the guitar in the normal mode without using the tremolo device of the invention, the tremolo device is in the condition shown in FIG. 1. In this condition, since the rotating force, in other words, the rotation moment derived from the tension of the springs 14, is preset to be larger than the rotating force in the anticlockwise direction derived from the total tension of the strings 7, the rotation of the upper plate 2 is limited by a part of the guitar body 4, i.e., as if the whole tremolo device 1 were substantially secured to the guitar body 4.

On the other hand, when producing a tremolo effect, the guitarist moves the tremolo arm 11 upward or downward in relation to the guitar body 4 in the same way as the conventional tremolo device. For example, when lowering the tone of the guitar, the guitarist moves the tremolo arm 11 downward toward the guitar body 4 as shown in FIG. 3.

Figure 3:
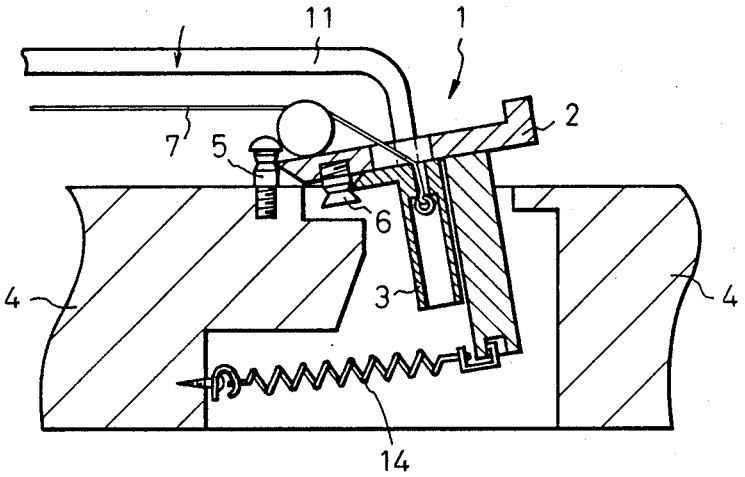
FIG. 3 is a longitudinal view similar to FIG. 1, in which the tremolo device is activated to lower the tones of the strings of the guitar.

In FIG. 3, the whole tremolo device 1 is rotated in the anticlockwise direction about the screws 5 providing the first fulcrum. In this condition, the tension of the strings 7 is reduced in comparison with the tension of the strings 7 in the condition shown in FIG. 1, to thereby lower the tone of the guitar.

Figure 4:
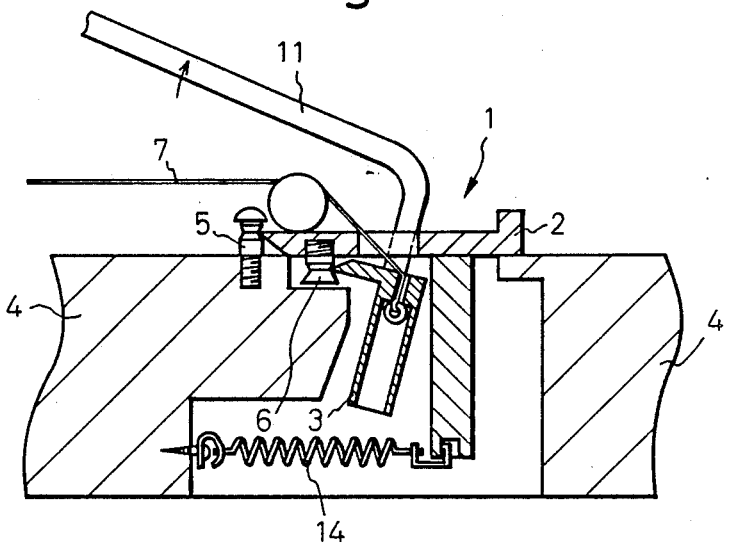
FIG. 4 is a longitudinal view similar to FIG. 1 in which the tremolo device is activated to raise the tones of the strings of the guitar.

When raising the tone of the guitar, the guitarist moves the tremolo arm upward away from the guitar body 4, as shown in FIG. 4. In this condition, the lower plate 3 is separated from the upper plate 2 and rotated alone in the clockwise direction about the second fulcrum, and this rotation causes the tension of the strings 7 to be increased in comparison with the condition shown in FIG. 1, to thereby raise the tone of guitar. During this movement, the upper plate 2 is still positioned on the guitar body 4, since the rear end of the upper plate 2 remains in contact with the guitar body 4.

When the handling of the tremolo device 1 is finished and the normal playing without the tremolo effect is resumed, the guitarist needs only to release the tremolo arm 11, whereby the tremolo device 1 is returned to the position shown in FIG. 1, since the rotating force derived from the tension of the springs 14 is larger than that derived from the tension of the strings 7, and thus the original and normal tuning of the guitar is obtained.

Figure 5:
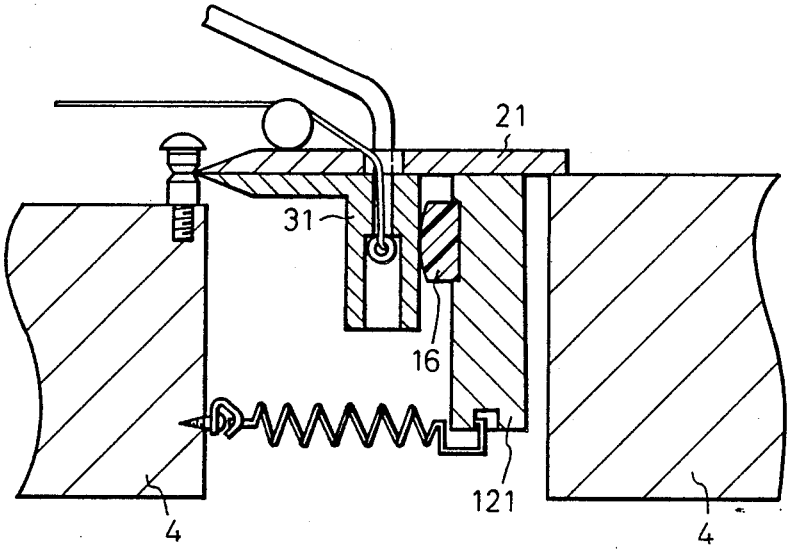
FIG. 5 is a partial longitudinal view of a guitar, showing a tremolo device in an inactivated condition according to a second embodiment of the present invention.

FIG. 5 shows another embodiment of the present invention. In this embodiment, a lower plate 31 different from the lower plate 3 in FIGS. 1 to 4 is provided, in which a second fulcrum of rotation is identical to a first fulcrum of the upper plate 21. These fulcrums are provided together on the guitar body 4. The operation of this tremolo device is substantially the same as that of the tremolo device 1 of the first embodiment.

Note that, when the guitarist changes continuously from the lowered tone to the raised tone, a slight shock may be produced when passing through the normal position as shown in FIGS. 1 and 5, and therefore, as typically shown in FIG. 5, the tremolo device may be equipped with a shock-absorbing material 16, such as an elastic rubber between a bar 121 of the upper plate 21 and the lower plate 31, to eliminate this shock.

As mentioned hereinabove, according to the present invention, by presetting the device in such a manner that the rotating force derived from the springs is larger than that derived from the strings, in a normal condition, and by ensuring that a part of the device is located in a predetermined position, a tremolo device can be provided which enables a precise return to the original tuning without causing the guitar to become out of tune, even after the device has been used.

Furthermore, according to the present invention, when the tremolo device is inactivated, it will remain in a condition such that it appears to be substantially secured to the guitar body, and therefore, the guitarist can play the guitar in the normal mode without the guitar becoming out of tune, even if the guitarist touches the tremolo device.

According to the first and second embodiments of the invention, by positioning the upper plate above the lower plate, even if the tremolo arm is moved upward to raise the tone of the guitar, the height of the strings from the guitar body will not vary from the height of the strings for the normal mode of playing, so that the playing condition can be unified.

Further, according to the present invention, the tremolo arm can be moved upward against only the tension of the strings, different from the handling of the conventional tremolo device with a "floating" construction, and accordingly, the guitarist can easily produce delicate variations of the tremolo effect.

Note that the tremolo device of the invention can be constructed to have the same size as a synchronized type of the tremolo device fitted to a "Stratocaster" guitar, one of the most widely-used guitars, made by the Fender Company, and thus the conventional device can be easily replaced by the tremolo device of the invention.

I claim:

1. A tremolo device for a guitar having a guitar head and a guitar body, comprising:

(1) an upper plate mounted on said guitar body to pivot about a first fulcrum, said upper plate being provided with holes through which strings of said guitar pass and having saddles on said upper plate for supporting said strings, said first fulcrum being located at a knife-edge-shaped front end of said upper plate in the direction of said guitar head;

(2) a lower plate, a substantial part of which is below said upper plate and which is pivotably mounted about a second fulcrum located at a knife-edge-shaped front end of said lower plate in the direction of said guitar head, said lower plate fixing one extremity of each of said strings in the vicinity of a rear end of said lower plate opposite to said lower plate front end;

(3) a tremolo arm secured at a rear side of said lower plate to pivot said lower plate about said second fulcrum;

(4) urging means for urging said upper plate in one rotating direction, said lower plate being urged due to the tension of said strings in another rotating direction opposite to said one rotating direction;

(5) a part of said guitar body coming in contact with a rear end of said upper plate on another side opposite to said guitar head to limit a degree of rotation of said upper plate in said one rotating direction, to thereby bring said upper plate to a predetermined position in contact with said part of said guitar body;

said upper plate cooperating with said part of said guitar body so that rotation of said lower plate is limited by contact of said upper plate of said part of said guitar body of said tremolo arm is inactivated, and said upper and lower plates being rotated together in said another direction when said tremolo arm is activated in such a manner that said lower plate is rotated in said another direction, and only said lower plate alone is rotated in said one rotating direction when said temolo arm is activated in such a manner that said lower plate is rotated in said one rotating direction.

2. A tremolo device according to claim 1, wherein said urging means comprise at least one spring having one end engaged in said guitar body and the other end engaged in a recess formed in a bar extending from said upper plate into a hole in said guitar body, and wherein a tension of said spring is preset in such a manner that a rotating force of said upper plate in said one rotating direction by said spring is larger than a rotating force of said lower plate in said another rotating direction due to said strings.

3. A tremolo device according to claim 1, wherein said guitar body is provided with a plurality of screws screwed therein, and including a plurality of said knife-edge abutments on said upper plate to provide said first fulcrum.

4. A tremulo device according to claim 1, wherein a normal and original tuning of said strings of said guitar is obtained in a position at which the rotation of said lower plate is limited by said upper plate in said predetermined position.

5. A tremolo device for a guitar having a guitar head and a guitar body, comprising:

(1) an upper plate mounted on said guitar body to pivot about a first fulcrum, said upper plate being provided with holes through which strings of said guitar pass and having string saddles on said upper plate for supporting said strings, said first fulcrum being located at a knife-edge-shaped front end of said upper plate in the direction of said guitar head;

(2) a lower plate, as substantial part of which is positioned and located below said upper plate and which is pivotably mounted about a second fulcrum located at a knife-edge-shaped front end of said lower plate in the direction of said guitar head, said lower plate anchoring one extremity of each of said strings in the vicinity of a rear end of said lower plate opposite to said front end;

(3) a tremolo arm secured at a rear side of said lower plate to pivot said lower plate about said second fulcrum;

(4) urging means for urging said upper plate in one rotating direction, said lower plate being urged due to the tension of said strings in another rotating direction opposite to said one rotating direction;

(5) a pair of said guitar body coming into contact with a rear end of said upper plate on another side opposite to said guitar head to limit a rotation of said upper plate in said one rotating direction, to thereby bring said upper plate to a predetermined position in contact with said part of said guitar body;

said upper plate cooperating with said part of said guitar body so that rotation of said lower plate is limited by contact of said upper plate with said part of said guitar body when said tremolo arm is inactivated, said upper and lower plates being rotate together in said another direction when said tremolo arm is activated in such a manner that said lower plate is rotated in said another direction, and only said lower plate alone is rotated in said one rotating direction when said tremolo arm is activated in such a manner that said lower plate is rotated in said one rotating direction.

6. A tremolo device according to claim 5, wherein said urging means comprise at least one spring having one end engaged in said guitar body and the other end engaged in a recess formed in a bar extending from said upper plate into a hole in said guitar body, and wherein a tension of said spring is preset in such a manner that a rotating force of said upper plate in said one rotating direction by said spring is larger than a rotating force of said lower plate in said another rotating direction due to said strings.

7. A tremolo device according to claim 5, wherein said guitar body is provided with a plurality of screws screwed therein, and including a plurality of said knife-edge abutments on said upper plate between said screws and said upper plate to provide said first fulcrum.

8. A tremolo device according to claim 5, wherein a normal and original tuning of said strings of said guitar is obtained in a position at which the rotation of said lower plate is limited by said upper plate in said predetermined position.

9. A tremolo device according to claim 5, wherein said second fulcrum is provided on said guitar body.

10. A tremolo device according to claim 5, wherein said second fulcrum is provided on said upper plate.

11. A tremolo device for a guitar having a guitar body and a guitar head, comprising:

(1) fulcrum means mounted on said guitar body, upper plate means pivotable about said fulcrum means, said upper plate means being provided with holes through which strings of said guitar pass, string saddles on said upper plate means for supporting said strings, said fulcrum means being located at a knife-edge-shaped front end of said upper plate means in the direction of said guitar head, and movement of said upper plate means being limited by a rear end thereof remote from said knife-edge-shaped front end and said fulcrum means;

(2) lower plate means, a substantial part of which is positioned and located below said upper plate means and which is pivotably mounted about said fulcrum means, said lower plate means including means for anchoring one extremity of each of said strings in the vicinity of a rear end of said lower plate means, and said strings alone urging said lower plate means into contact with said upper plate means, said strings being anchored to said lower plate means remote from said fulcrum means and said knife-edge-shaped end of said lower plate means;

(3) a tremolo arm secured at a rear side of said lower plate to pivot said lower plate about said fulcrum means;

(4) urging means for urging said upper plate means in one rotating direction, said lower plate being urge solely due to the tension of said strings in another rotating direction opposite to said one rotating direction;

(5) a part of said guitar body coming into contact with a rear end of said upper plate means on another side opposite to said guitar head to limit a rotation of said upper plate means in said one rotating direction, to thereby bring said upper plate means to a predetermined position in contact with said part of said guitar body;

said upper plate means cooperating with said part of said guitar body so that rotation of said lower plate means is limited by contact of said upper plate means with said part of said guitar body when said tremolo arm is inactivated;

said upper and lower plate means being rotated together in said another direction when said tremolo arm is activated in such a manner that said lower plate means is rotated in said another direction, and only said lower plate means alone is rotated in said one rotating direction when said tremolo arm is activated in such a manner that said lower plate means is rotated in said one rotating direction.

12. A tremolo device according to claim 11, wherein said fulcrum means is a single fulcrum provided on said guitar body, and both said knife-edge-shaped front end of said upper plate means and said lower plate means pivot on said single fulcrum.

13. A tremolo device according to claim 12, wherein said urging means comprise at least one spring having one end engaged in said guitar body and the other end engaged in a recess formed in a bar extending from said upper plate means into a hole in said guitar body means, and wherein a tension of said spring is preset in such a manner that a rotating force of said upper plate means in said one rotating direction by said spring is larger than a rotating force of said lower plate means in said another rotating direction due to said strings.

14. A tremolo device according to claim 12, wherein said guitar body is provided with a plurality of screws screwed therein, and including a plurality of said knife-edge abutments on said upper plate means to provide said fulcrum means.

15. A tremolo device according to claim 11, wherein said fulcrum means includes a first fulcrum cooperating with said upper plate means and provided on said guitar body and a second fulcrum cooperating with said lower plate means and provided on said upper plate means.

16. A tremolo device according to claim 15, wherein said urging means comprise at least one spring having one end engaged in said guitar body and the other end engaged in a recess formed in a bar extending from said upper plate means into a hole in said guitar body tension for said spring is preset in such a manner that a rotating force of said upper plate means in said one rotating direction by said spring is larger than a rotating force of said lower plate means in said another rotating direction due to said strings.

17. A tremolo device according to claim 15, wherein said guitar body is provided with a plurality of screws screwed therein, and including a plurality of said knife-edge abutments on said upper plate to provide said fulcrum means.

18. A tremolo device according to claim 11, including a shock absorbing material between said upper and said lower plate means.

* * * * *